US005290593A

United States Patent [19]

Poletto

[11] Patent Number: 5,290,593

[45] Date of Patent: Mar. 1, 1994

[54] PROCESS FOR CONVERTING COMPOSITE IMITATION LEATHER INTO SHEET MATERIAL SIMILAR IN APPEARANCE TO NATURAL LEATHER

[75] Inventor: Giorgio Poletto, Cirie', Italy

[73] Assignee: Lorica S.p.A., Milan, Italy

[21] Appl. No.: 851,907

[22] Filed: Mar. 16, 1992

[30] Foreign Application Priority Data

Mar. 19, 1991 [IT] Italy ..... T091A000198

[51] Int. Cl.[5] ..... B05D 3/12; B05D 1/36

[52] U.S. Cl. ..... 427/242; 427/262; 427/264; 427/412

[58] Field of Search ..... 427/262, 264, 242, 412; 428/151

[56] References Cited

U.S. PATENT DOCUMENTS

| | | | |
|---|---|---|---|
| 3,545,670 | 2/1971 | Shinohara et al. | 427/412 |
| 3,627,567 | 12/1971 | Tomio et al. | 427/412 |
| 3,908,060 | 9/1975 | Okazaki et al. | 427/412 |
| 3,919,451 | 11/1975 | Levy et al. | 427/412 |
| 3,984,607 | 10/1976 | Thoma et al. | 427/412 |
| 4,016,127 | 4/1977 | Larsson et al. | 427/412 |
| 4,017,656 | 4/1977 | Lasman et al. | 427/412 |
| 4,342,805 | 8/1982 | McCartney | 428/151 |
| 4,431,687 | 2/1984 | Föttinger et al. | 427/246 |
| 4,525,169 | 6/1985 | Higuchi et al. | 428/151 X |
| 4,863,479 | 9/1989 | Poletto | 427/242 X |
| 4,983,245 | 1/1991 | Schaefer | 427/412 |

FOREIGN PATENT DOCUMENTS

| | | |
|---|---|---|
| 0164076 | 12/1985 | European Pat. Off. . |
| 0303876 | 2/1989 | European Pat. Off. . |
| 1603437 | 11/1981 | United Kingdom . |

*Primary Examiner*—Marianne Padgett
*Attorney, Agent, or Firm*—Michael N. Meller

[57] ABSTRACT

A process for producing a sheet material similar in appearance to but cheaper and of inferior quality as compared with natural leather. A low-cost, poor-quality imitation leather, consisting of a composite sheet material having a polymer matrix with natural or synthetic fibers, is subjected to the same finish process applied in the tanning industry, which process consists in spraying and drying the exposed surfaces of the composite material, in successive stages, with hot-curing plastic dye resins, which are applied in a water or solvent mixture to which wax, pigments and/or metallized azoic dyes may be added; in hot calendering the material using engraved or smooth cylinders or plates; and, if necessary, in fulling the material in rotary drums.

4 Claims, No Drawings

PROCESS FOR CONVERTING COMPOSITE IMITATION LEATHER INTO SHEET MATERIAL SIMILAR IN APPEARANCE TO NATURAL LEATHER

BACKGROUND OF THE INVENTION

The present invention relates to a process for producing sheet material similar in appearance to but cheaper than natural leather, by processing any known type of imitation leather consisting of sheet material comprising a polymer matrix in which are embedded natural or synthetic fibers.

A lot of industrial applications, such as interior decorating or upholstering, do not always require high-tech materials. In the case of imitation leather, in particular, the only characteristic often required of the material is that it should look like natural leather. Whereas, for high fashion applications, imitation leather must not only look but also "feel" like natural leather, for interior decorating and other applications ranging from footwear to upholstering, very often the only requirement is that the material should look like natural leather, while at the same time being cheaper than both natural leather and high-tech microfibrous synthetic materials.

U.S. Pat. No. 4,766,014 filed by the present Applicant relates to a chemical process for converting imitation leather with a microporous polymer matrix into a material that, to the naked eye, is undistinguishable from natural leather. Notwithstanding the technical characteristics (abrasion and flame resistance, workability, etc.) of the material, which are superior to even those of natural leather, it is relatively expensive to produce, the best results being obtained by processing the same raw material used for producing imitation leather by the name of "SOFRINA" (registered trade mark) which is one of the best and most expensive currently available on the market. Moreover, the above process requires that the imitation sheet material be of a microporous type, which requires superior quality and, therefore, high-cost raw material.

SUMMARY OF THE INVENTION

It is an object of the present invention to provide a process whereby low-cost imitation leather, in particular consisting of sheet material with a nonporous or nonmicroporous polymer matrix, is given, if not the consistency, at least the appearance of natural leather.

According to the present invention, there is provided a process for producing sheet material of the same appearance as natural leather, characterized by the fact that a composite sheet material, comprising a polymer matrix coated or coagulated on or inside a nonwoven fabric or a fabric woven from natural or synthetic fibers, is subjected to the same finish process employed for tanned natural leather.

DETAILED DESCRIPTION OF THE INVENTION

The present Applicant discovered that, when subjected to the same finish process as natural leather at the semifinished stage, even poor quality imitation leather results in a product which, though inferior to natural leather in terms of mechanical characteristics (flexibility, abrasion resistance, etc.) and so-called "feel", presents the same appearance to the naked eye and the same feel when applied, and, while not deceiving an expert (unlike the synthetic product referred to in U.S. Pat. No.4,766,041), is a sufficiently good imitation to satisfy the average consumer. To a chemist in the tanning industry, it would seem absurd to apply the same finish process typically associated with natural leather to a synthetic material consisting of coated or coagulated nonporous polymers, in view of the widely differing physical and mechanical characteristics of such polymers as compared with natural leather, and particularly in view of the fact that the finish process is designed for application to tanned material, not a raw material having none of the prerequisites for which the finish process is specifically designed.

As such, a tanning expert or organic chemist could not possibility foresee any benefit, let alone the excellent results provided for by the present invention, by applying a process to an entirely different material from that for which the process was initially designed. Nor, in this sense, is any teaching derived from U.S. Pat. No. 4,766,014 filed by the present Applicant, in that the synthetic material referred to in the process not only presents, at the outset, the same physical and structural characteristics as natural leather, but is also subjected to a "chemical tanning" process which, while differing from the traditional tanning process, nevertheless imparts the same chemical and physical substrate typical of tanned natural leather.

The starting material according to the present invention is a composite sheet material comprising a polymer matrix in which are embedded reinforcing fibers: either natural, such as cotton, or synthetic, such as polyamide, polyester or polyurethane fibers. These are worked into yarns from which is produced a sheet of nonwoven or woven fabric on or inside which a polyurethane-based nonporous polymer matrix is coated or coagulated. In particular, the matrix material may be coagulated nonporous polyurethane (i.e. closed-cell, in the case of foam) and/or coated nonmicroporous polyurethane. Depending on the type of leather being imitated, the surface of the polyurethane matrix may be smooth, or embossed to imitate the pattern and/or grain of natural leather.

According to the present invention, the exposed surfaces of the above starting material, which is readily available on the market, are sprayed in a number of successive stages, each followed by a drying stage, with hot-curing plastic dye resins. Some of the resins, which are sprayed on using compressed air guns, are coloured, and others transparent or cover resins, to give a shiny, matt, brightly or multicoloured finish, etc. depending on the order in which they are applied to the synthetic sheet material. The resins used comprise mono- and bicomponent polyurethanes with added hardeners, silicones, waxes, inorganic pigments, metallized and nonmetallized azoic dyes, and vinyl resins. These are sprayed on diluted in solvent, which may be water (to give water-base mixtures) or any of a number of organic solvents including aliphatic-aromatic hydrocarbons, ketones, ethers, esters, alcohols.

Following application and drying of the resin solutions as described above, the sheet material so processed is hot calendered or embossed, during which stage polymerization of the sprayed-on mixtures occurs (or is completed). This stage consists in pressing the sheet material, either continuously in a strip between heated rotary cylinders, or in batches of precut portions using heated plates of a given size mounted on presses. The surface of the cylinders or plates contacting the processed surfaces/s of the material may be smooth or engraved to reproduce the pattern of the natural leather being imitated. The calendering operation, in addition to polymerizing the resins in the mixture by means of pressure and heat (calendering is performed at 60° to 150° C.), therefore also provides for producing a given pattern/grain on the processed surfaces.

Finally, the process according to the present invention also comprises a fulling stage, the main purpose of which is to mechanically soften the sheet material, normally already processed with the resins and calendered. This stage consists in loading the material, possibly in bales and with no chemicals added, inside drums rotating at a speed of 7 to 15 rpm.

Though testing was limited to the application of polyurethane and vinyl resins, the chemical affinity of which with the processed material undoubtedly provides for the best results, others such as acrylic, butadiene, nitrile and epoxy resins may also be used effectively.

A number of non-limiting embodiments of the present invention will be described in detail by way of examples.

EXAMPLE 1

Preparation of Product A

A 15 m long×145 cm wide strip of material, defined by a nonporous matrix of coagulated, emulsion polymerized polyurethane incorporating nylon 6 fabric (registered trade mark), is processed in spray painting booths equipped with compressed air guns and exhaust facilities, and in respective drying booths, both forming part of a known "FINISH LINE" plant (normally used for natural leather) using the compounds shown in Table 1 as follows:

A first undercoat of mixture A is applied and dried for 3–4 minutes at 60° C. This is followed by a first coat of mixture B; a further two coats of mixture B, each dried for 3–4 minutes at 60° C.; and, finally, a colourless top coat of mixture C. Mixtures A, B and C are applied on the sheet material to a thickness ranging from 50 to 300 gr/m2. The sheet is then embossed using a cylinder heated to 150° C. and engraved to reproduce the grain of cowhide, which is pressed on to the processed surface of the sheet at a pressure of 200 Kg/cm2. This operation polymerizes the coating and produces an embossed surface reproducing the grain of cowhide.

A further coat of mixture B is then sprayed on and dried, as described above, and the material fulled inside a 3 m diameter, 2 m wide drum rotating at a speed of 15 rpm.

The resulting sheet material is brown in colour and, to the naked eye, identical to napped cowhide.

TABLE 1

| | |
|---|---|
| | Mixture A (undercoat) |
| 30 parts | pigment mixture(*) |
| 320 parts | methyl ethyl ketone |
| 180 parts | cyclohexanone |
| 330 parts | ethyl glycol |
| 100 parts | soft monocomponent polyurethane* |
| 45 parts | semisoft monocomponent polyurethane** |
| 25 parts | dulling agent*** |
| | Mixture B (cover coat) |
| 500 parts | methyl ethyl ketone |
| 100 parts | acetate |
| 400 parts | cyclohexanone |
| 50 parts | silicone |
| 30 parts | dulling agent*** |
| 80 parts | monocomponent polyurethane* |
| 100 parts | bicomponent polyurethane**** |
| 10 parts | hardener***** |
| 30 parts | pigment mixture(*) |
| | Mixture C (top coat) |
| 1600 parts | methyl ethyl ketone |
| 900 parts | cyclohexanone |
| 700 parts | ethyl glycol |
| 200 parts | monocomponent polyurethane* |
| 100 parts | bicomponent polyurethane**** |
| 90 parts | dulling agent*** |
| 150 parts | silicone****** |

(*)IRON OXIDE BASED
*MELIO PL 524 (Quinn-Sandoz)
**U 4692 (Sthal)
***EUDERM SN DULLING AGENT (Bayer)
****TOP BAYDERM AN (Bayer)
*****BAYDERM RL HARDENER (Bayer)
******KS 132 (Sthal)

EXAMPLE 2

Preparation of Product B

A 60 m long×115 cm wide strip of material, defined by a nonporous matrix of polymerized polyurethane coated on to nonwoven fabric made of Nylon (registered trade mark), is processed as in Example 1 using the compounds shown in Table 2 as follows:

An undercoat of mixture D is applied and dried for 3–4 minutes at 80° C. This is followed by four successive coats of mixture E, each dried for 3–4 minutes at 80° C. as for the undercoat. From 50 to 300 gr of product is sprayed on per m2 of sheet material. Finally, the material is embossed using an engraved, 600 mm diameter cylinder heated to 100° C., which is pressed on to the processed surface of the sheet at a pressure of 230 Kg/cm2. This polymerizes the coating and produces an embossed surface reproducing natural buffalo hide.

The calendering stage is followed by a fulling stage as in Example 1.

The resulting material is beige in colour and, to the naked eye, identical to buffalo hide.

TABLE 2

| | |
|---|---|
| | Mixture D (undercoat) |
| 900 parts | waxy opaque polyurethane*** |
| 3600 parts | water |
| 600 parts | ethyl glycol |
| 600 parts | soft water-based bicomponent polyurethane film* |
| 1200 parts | rigid water-base bicomponent polyurethane film** |
| 150 parts | dulling agent**** |
| 200 parts | water-based silicone***** |
| 36 parts | cross-linking agent for water-based polyurethane(*) |
| 540 parts | pigment mixture****** |
| | Mixture E (cover coat) |
| 1800 parts | monocomponent polyurethane(+) |
| 19200 parts | water |
| 320 parts | ethyl glycol |
| 2000 parts | dulling agent**** |
| 1400 parts | silicone |
| 180 parts | cross-linking agent for water-based polyurethane(*) |
| 5600 parts | soft water-based bicomponent polyurethane film* |
| 2800 parts | rigid water-based bicomponent polyurethane film** |

TABLE 2-continued

| |
|---|
| 2000 parts pigment mixture****** |

(*)UA9048 (STHAL)
(+)Ex 4844 (STHAL)
*FONDO BAYDERM 50 UD (BAYER)
**EX 4845 (STHAL)
***RU 3506 (STHAL)
****EUDERM SN DULLING AGENT (BAYER)
*****KS 3139 (STHAL)
******IRON OXIDES - TITANIUM DIOXIDE - PHTHALOCYANINES

EXAMPLE 3

Preparation of Product C

A strip of material of the same size as in Example 2, defined by a nonporous matrix of polymerized polyurethane with a sculptured surface, incorporating a mat of nonwoven polyester fabric, is processed as in Example 1, using the compounds in Table 3 as follows:

An undercoat of mixture F is applied to a thickness of 10 to 150 gr per square meter of sheet material and dried for 4–5 minutes at 80° C. This is followed by six successive coats of mixture G, each dried for 4–5 minutes at 80° C. as for the undercoat. Each coat is sprayed to a thickness of 50 to 150 gr of product per square meter of sheet material.

The material is then calendered using a specular cylinder heated to 120° C. and pressed on to the processed surface of the sheet at a pressure of 180 Kg/cm2. This polymerizes the coating as well as enhancing the existing sculptured surface of the initial polymer matrix. The calendering stage is followed by a fulling stage as in Example 1.

The resulting material is white in colour and, to the naked eye, identical to sheep- and goatskin.

TABLE 3

| | |
|---|---|
| | Mixture F (undercoat) |
| 150 parts | methyl ethyl ketone |
| 100 parts | cyclohexanone |
| 60 parts | ethyl glycol |
| 230 parts | vinyl resin* |
| 40 parts | dulling agent**** |
| 15 parts | silicone***** |
| 50 parts | white pigment(**) |
| | Mixture G (undercoat) |
| 3 parts | cross-linking agent(*) |
| 75 parts | methyl ethyl ketone |
| 100 parts | cyclohexanone |

TABLE 3-continued

| | |
|---|---|
| 95 parts | butyl acetate |
| 20 parts | vinyl resin** (soft) |
| 75 parts | vinyl resin*** (medium soft) |
| 20 parts | dulling agent****** |
| 20 parts | silicone***** |
| 30 parts | white pigment(**) |

(*)LS 3368 (ROMM - HAAS)
*LS 3224 (ROMM - HAAS)
**LS 3363 (ROMM - HAAS)
***LS 3383 (ROMM - HAAS)
****LS 3344 M (ROMM - HAAS)
*****KS 3121 (ROMM - HAAS)
******DULL 07 (ROMM - HAAS)
(**)TITANIUM DIOXIDE BASE WHITE PIGMENT

I claim:

1. A process for producing sheet material of the same appearance and feel as natural leather when applied as a surface cover, said process comprising the steps of:

subjecting a simulated leather sheet material selected from the group consisting of essentially non-microporous composite sheet materials comprising a polymeric nonporous matrix coated or coagulated on or inside a nonwoven fabric or a fabric woven from natural or synthetic fibers to a series of finishing operations of the type to which tanned natural leather is subjected while not damaging the composite sheet material used, said finishing operations comprising at least (a) spraying the exposed surfaces of the composite sheet material with heat-curing plastic dye resins, each spraying followed by a respective drying stage, and (b) heat-calendaring said exposed surfaces sprayed with the heat-curing resins using engraved or smooth cylinders or plates.

2. A process as claimed in claim 1, wherein said composite sheet material is one of a group of nonmicrofibrous nonwoven fabrics of polyamide, polyester, polyethylene or cotton yarn in a nonporous coagulated polyurethane matrix with a smooth or embossed surface; or nonmicrofibrous nonwoven fabrics of polyamide, polyester, polyethylene or cotton yarn in a nonporous coated polyurethane matrix with a smooth or embossed surface.

3. A process as claimed in claim 1, wherein said resins are applied in a water or solvent mixture to which wax, pigments and/or metallized azoic dyes may be added.

4. A process as claimed in claim 1, wherein said finish process also comprises a fulling stage wherein the sheet material is fulled inside rotary drums.

* * * * *